US005745138A

United States Patent [19]

Ostermeier

[11] Patent Number: 5,745,138

[45] Date of Patent: Apr. 28, 1998

[54] INK CHAMBER WITH PRESSURE RELIEF CHAMBER HAVING PRESSURE RELIEF APERTURE AND MICROPARTICLES TO EXERT CAPILLIARY ACTION ON INK

[76] Inventor: Bruce H. Ostermeier, 4411 Brookside St., Irvine, Calif. 92714

[21] Appl. No.: 643,701

[22] Filed: May 16, 1996

[51] Int. Cl.[6] ..... B41J 2/175

[52] U.S. Cl. ..... 347/85; 347/86

[58] Field of Search ..... 347/85, 86, 87

[56] References Cited

U.S. PATENT DOCUMENTS

| | | | |
|---|---|---|---|
| 4,875,059 | 10/1989 | Masuda | 347/93 |
| 5,079,570 | 1/1992 | Mohr et al. | 347/7 |
| 5,567,373 | 10/1996 | Sato et al. | 264/112 |

*Primary Examiner*—David F. Yockey
*Assistant Examiner*—Christina Annick
*Attorney, Agent, or Firm*—Frederic P. Smith; William F. Porter, Jr.

[57] ABSTRACT

An ink jet cartridge comprising an ink chamber, at least one aperture coupling a pressure relief chamber to the ink chamber, the aperture having a small internal diameter for creating a negative pressure on any ink in the lower portion of the ink chamber and a plurality of microparticles positioned in the pressure relief chamber for forming a plurality of small interstices which form a capillary path in the pressure relief chamber, the microparticles creating a negative pressure on any ink in the lower portion of the ink chamber and the selected size of the microparticles resulting in a capillary path of selected size for controlling the magnitude of the negative pressure in the lower portion of the ink chamber. The pressure relief chamber is positioned below the ink chamber, the ink chamber including an opening to couple the ink cartridge to an ink jet head and the aperture is positioned at the lower portion of the ink chamber.

4 Claims, 1 Drawing Sheet

INK CHAMBER WITH PRESSURE RELIEF CHAMBER HAVING PRESSURE RELIEF APERTURE AND MICROPARTICLES TO EXERT CAPILLIARY ACTION ON INK

BACKGROUND OF THE INVENTION

1. Field of the Invention

This invention relates to the field of ink cartridges for plotters and, in particular, to an improved large capacity ink cartridge for an ink jet printer.

2. Description of Related Art

With the increased use of computer hardware and software to generate information in visible multidimensional form such as graphs and graphics, there has come a concomitant increase in the use of plotters to fix such information on a tangible media. Plotters capable of handling the output of such computer systems have been developed and are continually being upgraded to ensure that fast and accurate plots will be produced. Problems have arisen with ink jet type printers in which the ink jet head, or inker, applies ink to a media surface. In order to increase the time between replacement of ink supplies, larger ink jet cartridges are being used. However, the increased volume of ink held by these cartridges has caused problems in controlling the evenness of flow of ink to the head. Such increased volume of ink has also caused leakage of ink from both the cartridge and the head itself due to variations in temperature and atmospheric pressure. In order to solve these problems, numerous cartridges use a controlled porosity polyurethane foam in various parts of the cartridge to control both the flow to and leaking of ink from the head and the leaking of ink from the cartridge. Since the porosity of the foam and the extended surface area of the foam presented to the ink chamber are difficult to control, these devices can handle only a limited volume of ink. These problems have been overcome in a prior patent application, Ser. No. 08/434,218, entitled "Large Capacity Ink Cartridge", filed May 4, 1995 and assigned to the same assignee as the present invention, by the use of an ink cartridge comprising an ink chamber, a pressure relief chamber coupled to the ink chamber, and at least one air bleed hole coupling the pressure relief chamber to the ink chamber, the air bleed hole having a capillary dimension for creating a negative pressure on any ink in the ink chamber. The pressure relief chamber is positioned below the ink chamber, the ink chamber including an opening to couple the ink cartridge to an ink head, the opening including an automatic shutoff valve, and the air bleed hole is positioned at the bottom of the ink chamber.

It has been found, however, that under certain circumstances the installation or removal of the cartridge from the printer may cause ink to be forced from the ink jet nozzles. This is particularly evident where there is ink in the pressure relief chamber when the cartridge is installed. This situation will cause a slight positive pressure to be exerted on the ink in the nozzles of the ink jet head. Normally, this positive pressure, caused by the hydraulic head from the ink chamber, the magnitude of which depends on the amount of ink in the pressure relief chamber and the placement of the pressure relief chamber with respect to the ink chamber, is not enough to force ink from the ink jet nozzle because the capillary pressure created with an ink jet nozzle is about an order of magnitude greater than the hydraulic head developed in the pressure relief chamber. In many instances, however, the ink jet head is not clean and a film of ink or some other contaminant has been left on the nozzle plate of the head. A film of ink causes the radius of curvature of the meniscus in the nozzle to go to infinity with a consequent loss of capillary pressure holding the ink in the nozzle. A contaminant will also cause the radius of curvature of the meniscus in the nozzle to become bigger if it is wet by the ink. Once the ink wets the contaminant, the meniscus in the nozzle is pulled outside the nozzle cavity and creates a drop hanging from the nozzle plate. Since cleaning apparatus for nozzle heads are not perfect, this occurs more than is desirable, making it necessary for the ink cartridge to exert a negative pressure at all times. Since, however, the air bleed hole is filled with ink, its negative pressure capability in not usable in this situation. Thus, it is necessary that an additional source of negative pressure be provided that is operational when the air bleed hole is not. While the use of reticulated foam in the pressure relief chamber would under certain circumstances provide such a negative pressure, since the open cell structure forms capillary holes that can exert pressure on the ink, cutting, compressing and fitting the foam to the size of the pressure relief chamber is difficult and hard to control, particularly since the degree of negative pressure is determined by the largest of the holes, i.e., the larger the hole, the less the negative pressure.

Thus, it is a primary object of the present invention to provide an improved large capacity cartridge for an ink jet printer.

It is a another object of the present invention to provide an improved large capacity cartridge for an ink jet printer that prevents leakage of ink from the ink head upon installation or removal of the cartridge.

It is further object of the present invention to provide an improved large capacity cartridge for an ink jet printer that constantly provides negative pressure control to prevent leakage of ink from the cartridge upon installation or removal of the cartridge.

It is still another object of the present invention to provide an improved large capacity cartridge for an ink jet printer that permits a wide range of negative pressure control to prevent leakage of ink from the cartridge upon installation or removal of the cartridge.

It is a further object of the present invention to provide an improvement to a large capacity cartridge for an ink jet printer that provides a constant negative pressure control to prevent leakage of ink from the cartridge upon installation or removal of the cartridge and that is inexpensive to manufacture and install and does not require any special molding, cutting or packing.

SUMMARY OF THE INVENTION

An improved ink cartridge comprising an ink chamber, a pressure relief chamber coupled to the ink chamber, at least one air bleed hole coupling the pressure relief chamber to the ink chamber, the air bleed hole having a capillary dimension for creating a negative pressure on any ink in the ink chamber, and a plurality of microparticles positioned in the pressure relief chamber for forming a plurality of interstices of capillary dimension in the pressure relief chamber, the microparticles creating a negative pressure on any ink in the ink chamber and the dimensions of the microparticles forming a selected capillary dimension for controlling the magnitude of the negative pressure. The pressure relief chamber is positioned below the ink chamber, the ink chamber including an opening to couple the ink cartridge to an ink head, and the air bleed hole is positioned at the bottom of the ink chamber.

The novel features which are believed to be characteristic of the invention, both as to its organization and method of operation, together with further objects and advantages thereof, will be better understood from the following description in connection with the accompanying drawings in which the presently preferred embodiment of the invention is illustrated by way of example. It is to be expressly understood, however, that the drawings are for purposes of illustration and description only and are not intended as a definition of the limits of the invention.

DESCRIPTION OF THE PREFERRED EMBODIMENT

Figure 1:
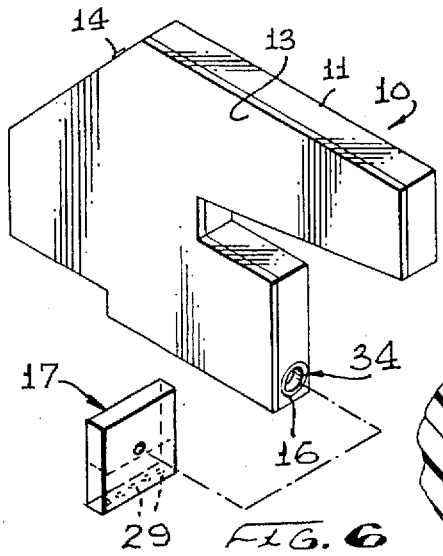
FIG. 1 is a perspective front view of the structure of the present invention.
Figure 2:
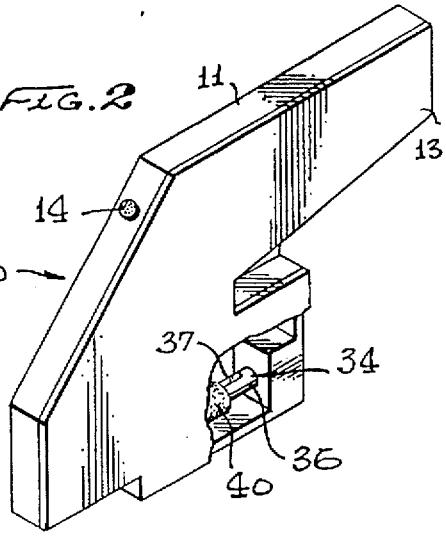
FIG. 2 is a perspective rear view, partially broken away, of the structure of the present invention.
Figure 6:
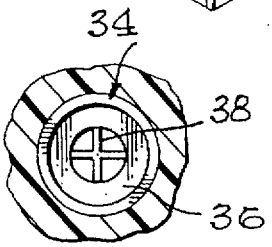
FIG. 6 is a cross-sectional view taken along line 6—6 of FIG. 3.
Figure 7:
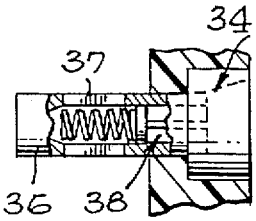
FIG. 7 is a side-view, partially broken away, of the valve mechanism used in the present invention.
Figure 3:
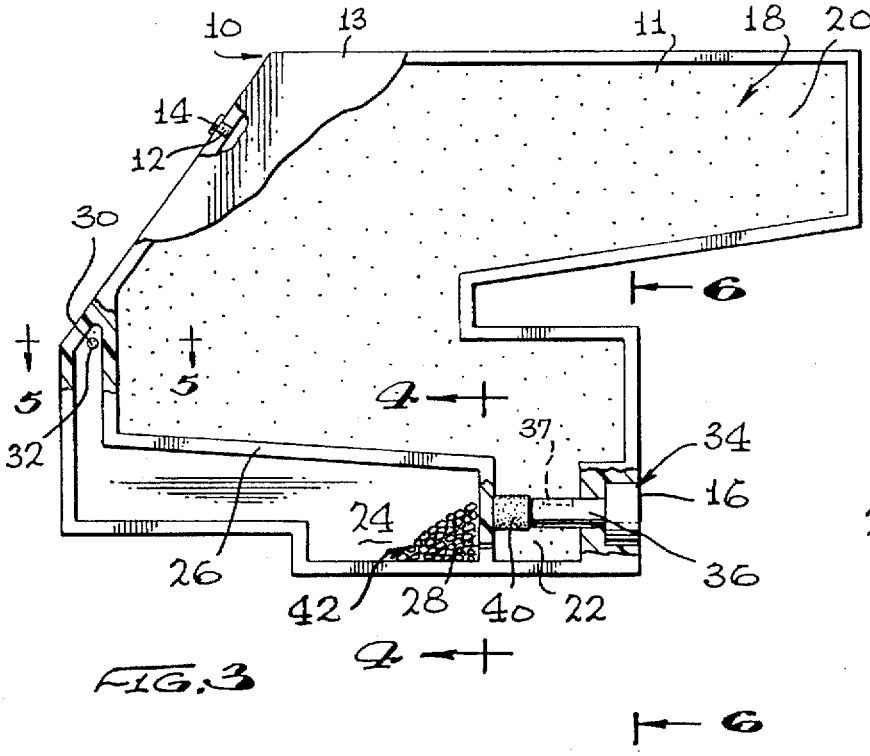
FIG. 3 is a side view, partly broken away, of the structure of the present invention.
Figure 5:
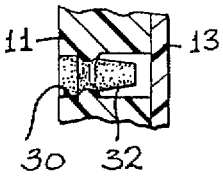
FIG. 5 is an enlarged cross-sectional view taken along line 5—5 of FIG. 3.
Figure 4:
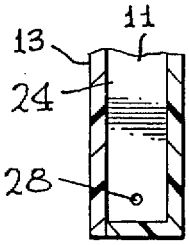
FIG. 4 is a cross-sectional view of FIG. 3 taken along line 4—4 of FIG. 3.

In order to fully understand the present invention, a description of the device of the above-recited Patent Application is necessary. Referring now to FIGS. 1–3, a cartridge 10 is shown having a housing 11 and a housing cover 13. The cartridge 10 has a fill hole 12 and a fill plug 14 and an opening 16 for connection to tubing leading to an ink head 17. The cartridge 10 has an ink chamber 18 having an upper portion 20 and a lower portion 22 adjacent to the opening 16 for providing ink to the ink head. Below the upper portion 20 and adjacent to the lower portion 22 is a pressure relief chamber 24 separated by wall 26 from the ink chamber 18 and coupled to the lower portion 22 and the opening 16 by at least one air bleed hole or aperture 28, shown also in FIG. 4. As explained more fully hereinafter, the air bleed hole 28 has a capillary dimension to create a negative air pressure on the ink in the lower portion 22 of the ink chamber 18. The pressure relief chamber 24 has a vent hole 30 extending through the housing 11 to the outside atmosphere and a porous plug 32 positioned inside and extending through the vent hole 30 into the interior of the chamber 24, as shown in FIG. 5. The opening 16 has positioned therein, as shown in FIGS. 3 and 6–7, a automatic shutoff valve 34 which has an outer body or housing 36 and an inner body 38 which is spring-loaded so that in a disconnected mode the inner body 38 seals the valve 34 and prevents ink from leaking out and in a connected mode is forced inwardly by the tube from the ink head to open the valve 34 and allow ink to flow through the outer body 36 to the ink head. The housing 36 has a plurality of slots 37 therein which go through opposite sides of the housing 36 and are vertically oriented so that on filling an empty cartridge 10 with ink air is not trapped within the valve 34 which could cause difficulties in the initiation of the ink flow without excessive vacuum in the purge cycle. The opening 16 also includes a wicking plug 40 which is positioned between the valve 34 and the wall 26 and which functions as a surge suppressor without restricting flow. The porous plug 32 acts in conjunction with the valve 34 to keep ink from leaking out the vent hole 30 when the cartridge 10 is oriented in any direction unless the porous plug 32 becomes covered with ink and a temperature increase inside the cartridge forces ink through the porous plug 32. The porous plug 32 is made from a hydrophobic material, such as porous teflon, and has a surface free energy less than the surface tension of the ink.

Initially, the ink chamber 18 of the cartridge 10 is filled to capacity with all air excluded, the fill plug 14 is inserted and sealed and the vent hole 30 is covered with sealing tape (not shown), the pressure relief chamber 24 remaining filled with air. Automatic shutoff valve 34 acts to prevent ink leakage when the cartridge 10 is not installed in the ink jet printer and also during installation or removal of the cartridge 10 from the ink head. Furthermore, the valve 34 functions to contain the ink in the ink cartridge 10 during thermal cycles, as discussed hereinafter. When the cartridge 10 is about to be connected to the ink head, the sealing tape is removed. The ink is held in the ink chamber 18 by the atmospheric pressure exerted on the air bleed hole 28 through the pressure relief chamber 24 from the open vent hole 30. No movement of the ink occurs until the cartridge 10 is connected to the ink head and air enters the air bleed hole 28 to replace the ink removed. When the cartridge 10 is connected by a tube from the ink head being inserted into opening 16, the valve 34 is opened. There is still little or no ink flow from the cartridge 10 due to the capillary dimensions defining capillary pathways of both the air bleed hole 28 and the ink head nozzles 29 until the ink head is purged, generally by an applied vacuum of sufficient magnitude to exceed the capillary action of both the nozzles and the air bleed hole 28. As the vacuum is applied to the ink head, ink is pulled from the cartridge 10 and, simultaneously, air is pulled in through the vent hole 30 into the pressure relief chamber 24 and through the capillary air bleed hole 28 to displace the ink removed. It is assumed that the cartridge 10 is connected directly to the ink head, that the ink head nozzles are located somewhat below the connection to the cartridge 10, generally one inch or less, and that once connected there is no pathway for air to be drawn into the ink head, i.e. there is an air tight connection. Additionally, the diameters of the ink head nozzles are on the order of one to two thousandths of an inch and operate at a slightly negative pressure, with the ink meniscus at the nozzles being slightly concave, all of which causes a capillary action to act to control the ink at the ink head and stop the ink from leaking.

As is apparent then, the capillary diameter of the air bleed hole 28, generally of the order of 30 thousandths of an inch, maintains a partial vacuum on the ink chamber 18 due to such capillary dimensions and, more particularly, maintains a partial vacuum on the ink in the lower portion 22 of the ink chamber 18 due to its being positioned at the bottom of the ink chamber 18. This is in contrast to prior art devices in which the pressure exerted by the ink on the ink head was atmospheric pressure plus the hydraulic head due to the height difference between the nozzles and a non-capillary dimension air bleed hole between an ink chamber and an air pressure relief chamber. Furthermore, the provision of such a capillary air bleed hole 28 provides a backup to the capillary action of the ink head nozzles to stop leakage at the ink head by providing a partial vacuum on the ink head nozzles and also assures that ink is not pulled too rapidly from the cartridge 10 during purging. In addition, ink is always delivered to the ink head at a constant pressure and flow for the life of the cartridge 10 due to the provision of the air bleed hole 28 of constant capillary diameter, since the pressure at the ink head nozzles is established and maintained by (1) the balance of air and vapor in the ink chamber 18, (2) the liquid level of ink in the ink chamber 18, (3) the capillary force of the air bleed hole 28 and (4) the atmospheric pressure exerted on the liquid interface in the air bleed hole 28, and air is automatically drawn in through the air bleed hole 28 to maintain this pressure balance. Since ink pressure and flow are controlled by air flowing through the air bleed hole 28, the magnitude of the pressure is controlled by the diameter of the air bleed hole 28 and can be varied by changing such diameter and the magnitude of the flow is controlled by the area of the air bleed hole 28 and can be varied independently of pressure by having a plurality of air bleed holes 28 of fixed diameter whose summed area equals the hole area necessary to generate the desired magnitude of flow. For example, if the diameter of the air bleed hole 28 were 15 thousands of an inch, then nine air bleed holes of 5 thousands of an inch in diameter would be used. In addition, the capillary dimension of the air bleed hole 28 is generally of an order of magnitude larger than the capillary dimension of the ink jet nozzles. However, the capillary dimension of the air bleed hole 28 can range from 2–20 times the capillary dimension of the ink jet nozzles.

As stated previously, it has been found that under certain circumstances the installation or removal of the cartridge from the printer may cause ink to be forced from the ink jet nozzles, particularly where there is ink in the pressure relief chamber, or even in the air bleed hole 28, when the cartridge is installed (nullifying the capillary action of the air bleed hole) and a slight positive pressure is thus exerted on the ink in the nozzles of the ink jet head and the ink jet head is not clean and a film of ink or some other contaminant has been left on the nozzle plate of the head with a consequent loss of capillary pressure holding the ink in the nozzle. In order to rectify this problem and provide a negative pressure at all times, the pressure relief chamber 24 has been filled with a plurality of microparticles 42. The microparticles 42 are generally inserted into the pressure relief chamber 24 through vent hole 30 by a vacuum applied to fill hole 12, thus conforming to the shape of the pressure relief chamber 24 and easily forming a tight cellular structure. The microparticles 42 are generally microbeads of solid or hollow glass or plastic and may be spherical with a smooth or textured surface or any other suitable solid shape and dimension that will form the interstices of a cellular structure to form a capillary path providing the desired capillary action on the ink. By selecting the proper size and shape, capillary pressure can be controlled easily and over a wide range. In order for the microparticles 42 not to enter the ink chamber 18 or to plug the air bleed hole 28 and thus shut off or impede ink flow, the microparticles 42 should be slightly larger than the air bleed hole 28, generally 2–3 times larger in diameter than the air bleed hole 28. In addition, the size of the microparticles 42 is generally chosen to maintain a negative pressure near to that of the air bleed hole 28.

It should be noted that altering the design of cartridge 10 using microparticles 42 has no effect on the operation of the cartridge 10 except when the pressure relief chamber 24 contains ink. The pressure relief chamber 24 should also be designed so that the microparticles 42 are not totally immersed in ink which would nullify the capillary action of the microparticles. Since the ink removed from the cartridge 10 must be replaced by air, any ink in the pressure relief chamber 24 is used before ink is drawn from the ink chamber 18. The flow rate of the ink is still maintained by the number of air bleed holes 28 between the pressure relief chamber 24 and the ink chamber 18. Ink cannot flow from the ink chamber 18 until the fluid level in the pressure relief chamber 24 exposes the air bleed hole 28. Consequently, the pressure relief chamber 24 empties first. Once the ink has emptied from the pressure relief chamber, the negative pressure is again maintained by the size of the air bleed hole 28 between the pressure relief chamber 24 and the ink chamber 18. Thus for more precise control of flow rate and negative pressure, it is preferable to use the microparticles 42 in conjunction with the air bleed hole 28.

As stated above, the cartridge 10 has the pressure relief chamber 24 located below the upper portion 20 of the ink chamber 18. This enables the cartridge 10 to accommodate large temperature changes when connected to the ink head without leaking. On heating, any air in the ink chamber 18 expands and the water vapor pressure from the ink increases exerting pressure on the ink in the ink chamber 18. Since the valve 34 is open, valve 34 cannot isolate ink from the ink head. Because the nozzles in the ink head are smaller in diameter than the air bleed hole 28, capillary action will favor ink flow through the air bleed hole 28 and the pressure buildup is relieved by ink flowing into the pressure relief chamber 24. When the temperature returns to its original state, ink will be drawn into the ink chamber 18 from the pressure relief chamber 24 by the contraction of air and reduction of vapor pressure and because the location of the air bleed hole 28 maintains contact with any ink in the pressure relief chamber 24. The positioning of the pressure relief chamber 24 at the bottom of the cartridge 10 below the ink chamber 18 minimizes the transfer of hydraulic pressure to the ink head nozzles when ink fills the pressure relief chamber 24 due to pressure buildup. Additionally, the pressure relief chamber 24 also relieves pressure buildup when a disconnected cartridge 10 is subject to temperature changes. While normally, i.e., without the use of microparticles 42, the chamber 24 is made large enough for the cartridge 10 to accommodate liquid transfer resulting from temperature changes of up to 40° Celsius, since the microparticles 42 reduce the available volume in the chamber 24 by approximately one-half, adjustments have to be made to reduce the thermal tolerance of the cartridge 10 or to increase the size of the chamber 24 to both accommodate the microparticles 42 and allow for the increased expansion at 40° Celsius. The ink chamber 18 is generally made to hold at least 30 ml of ink instead of the typical 9 ml and the pressure relief chamber 24 is generally made to hold 6 ml of ink. The size of the pressure relief chamber 24 is based on the volume of ink, air and vapor in the cartridge 10 and the range of temperature change. When the cartridge 10 is inverted, excess air and vapor will exit through the pressure relief chamber 24 now at the top of the cartridge 10. When the cartridge 10 is returned to the upright position, the partial vacuum in the ink chamber 18 above the ink is reestablished. The ink level in the ink chamber 18 will drop slightly and some ink may move from the ink chamber 18 to the pressure relief chamber 24 to balance the system.

While the invention has been described with reference to a particular embodiment, it should be understood that the embodiment is merely illustrative as there are numerous variations and modifications which may be made by those skilled in the art. Thus, the invention is to be construed as being limited only by the spirit and scope of the appended claims.

I claim:

1. An ink jet cartridge comprising:

an ink chamber;

a pressure relief chamber coupled to said ink chamber;

a common wall positioned between said ink chamber and said pressure relief chamber;

at least one aperture positioned in said common wall and coupling said pressure relief chamber to said ink chamber, said aperture having a small internal diameter providing a capillary action to ink within said ink chamber; and a plurality of microparticles positioned in said pressure relief chamber, said microparticles forming a plurality of interstices, said interstices forming a capillary path in said pressure relief chamber, wherein said cartridge is coupled to an ink jet head having ink jet nozzles therein, each of said nozzles having a selected internal size and forming a capillary path for ink flowing therethrough, said small internal diameter of said aperture being larger than said selected internal size of said nozzles and said microparticles having a size larger than said internal diameter of said aperture.

2. The cartridge of claim 1 wherein said small internal diameter of said aperture is two to twenty times larger in size than said selected internal size of said nozzles and said microparticles are a factor of two greater in size than said aperture.

3. A pressure relief chamber for use in an ink jet cartridge having an ink chamber comprising:

a pressure relief chamber, said pressure relief chamber configured to be coupled to said ink chamber by at least one aperture, said aperture having a small internal diameter; and a plurality of microparticles positioned in said pressure relief chamber and having a size larger than said small internal diameter of said aperture, said microparticles forming a plurality of interstices, said interstices forming small capillary paths in said pressure relief chamber.

4. The pressure relief chamber of claim 3 wherein said microparticles are a factor of two greater in size than said internal diameter of said aperture.

* * * * *